US011751683B1

(12) United States Patent
Cheng

(10) Patent No.: US 11,751,683 B1
(45) Date of Patent: Sep. 12, 2023

(54) HOOK CONNECTION STRUCTURE OF SHELF

(71) Applicant: WIRE MASTER INDUSTRY CO., LTD., Changhua County (TW)

(72) Inventor: Shen-Jung Cheng, Changhua County (TW)

(73) Assignee: WIRE MASTER INDUSTRY CO., LTD., Changhua County (TW)

( * ) Notice: Subject to any disclaimer, the term of this patent is extended or adjusted under 35 U.S.C. 154(b) by 0 days.

(21) Appl. No.: 17/979,449

(22) Filed: Nov. 2, 2022

(51) Int. Cl.
*A47B 57/40* (2006.01)
*A47B 96/14* (2006.01)

(52) U.S. Cl.
CPC ..... *A47B 57/40* (2013.01); *A47B 96/1441* (2013.01)

(58) Field of Classification Search
CPC ... A47B 57/40; A47B 96/1441; A47B 96/145; A47B 61/003; A47B 96/06; A47B 96/061; A47B 96/067; A47B 96/04; A47B 57/30; A47B 57/32; A47B 57/38; A47B 57/404
See application file for complete search history.

(56) References Cited

U.S. PATENT DOCUMENTS 2,859,879 A * 11/1958 Rogers ..... A47B 96/061 211/90.01
3,702,591 A * 11/1972 Banse ..... A47B 96/027 211/90.01
6,267,063 B1 * 7/2001 Cline ..... A47B 96/02 108/42
6,969,036 B2 * 11/2005 Magnusson ..... A47B 55/02 248/339
7,086,544 B1 * 8/2006 Doench ..... A47B 96/028 248/222.51
D580,258 S * 11/2008 Fernandez ..... D8/381
7,516,930 B2 * 4/2009 Chen ..... F16B 7/0433 248/304
8,132,768 B2 * 3/2012 Fernandez ..... A47B 96/06 248/257
D668,136 S * 10/2012 Nicholls ..... D8/380
8,646,624 B2 * 2/2014 Fernandez ..... A47B 47/022 211/90.03
8,905,248 B1 * 12/2014 Wolski ..... A47B 57/26 211/90.03
9,226,577 B2 * 1/2016 Stepp ..... A47B 81/005
9,277,814 B2 * 3/2016 Winker ..... A47B 96/02
D753,420 S * 4/2016 Cheng ..... D6/675.2
(Continued)

*Primary Examiner* — Devin K Barnett
(74) *Attorney, Agent, or Firm* — Chun-Ming Shih; LANWAY IPR SERVICES

(57) ABSTRACT

A hook connection structure of a shelf is configured to connect a fixing rod between two hooks which are connected on two bottoms of two connection racks, and the fixing rod is mounted below a holding plate by using the two hooks. The hook connection structure contains: a respective one hook including a connection portion which has an extension, an engagement section, a contact rib, and a stop tab. A respective one of two connection racks includes a slot formed on an elongated portion of the respective one connection rack, a notch defined on the slot, such that the stop tab of the extension of the respective hook abuts against the elongated portion of the respective one rack, the respective one hook is connected on a bottom of the respective one connection rack, and the fixing rod is mounted below the holding plate to hang objects.

5 Claims, 9 Drawing Sheets

(56) References Cited

U.S. PATENT DOCUMENTS

| | | | | |
|---|---|---|---|---|
| 10,098,460 | B1 * | 10/2018 | Brinton, Jr. | A47B 96/145 |
| 10,634,279 | B2 * | 4/2020 | Lu | A47B 96/1441 |
| 10,806,253 | B2 * | 10/2020 | Stocker | A47B 47/022 |
| 11,297,965 | B2 * | 4/2022 | Kenney | A47H 1/142 |
| 2005/0150436 | A1 * | 7/2005 | Marchetta | A47B 96/028 108/108 |
| 2006/0261230 | A1 * | 11/2006 | Lee | A47B 61/003 248/304 |
| 2009/0139943 | A1 * | 6/2009 | Fernandez | A47F 5/0869 211/94.01 |
| 2020/0281353 | A1 * | 9/2020 | Brinton, Jr. | A47G 25/06 |
| 2021/0321769 | A1 * | 10/2021 | Switzer | A47B 61/003 |
| 2023/0012176 | A1 * | 1/2023 | Cheng | A47B 96/067 |

* cited by examiner

HOOK CONNECTION STRUCTURE OF SHELF

FIELD OF THE INVENTION

The present invention relates to a hook connection structure of a shelf which is configured to connect a fixing rod on two bottoms of two connection racks so as to hang objects, and the respective one hook is engaged on the bottom of the respective one connection rack by using the extension of the respective one hook and the respective one connection rack.

BACKGROUND OF THE INVENTION

A conventional shelf is applied to display commodity or to store household objects, and the shelf contains at least one support column, at least one connection rack connected with the at least one support column, and at least one holding plate mounted on the at least one connection rack, such that the objects are accommodated on the at least one holding plate. Preferably, a distance between any two adjacent holding plates is adjustable.

To connect the at least one support column and the at least one connection rack of the shelf, a respective one support column includes multiple longitudinal slots defined on a same distance, and a respective one connection rack includes a pair of insertion sheets extending from a top of a coupling end, a recess defined on each insertion sheet and the respective one connection rack, a pair of retainers extending from a bottom of each insertion sheet, wherein a distance between the recess and each retainer is equal to a distance between any two adjacent longitudinal slots of the respective one support column, such that the insertion sheet of the coupling end of the respective one connection rack is received in a respective one longitudinal slot of the respective one support column, and the respective one connection rack is pressed downward so that each retainer is engaged in the respective one longitudinal slot, and the recess is retained below the respective one longitudinal lost, thus connecting the respective one connection rack and the respective one support column. In addition, the respective one connection rack is configured to support a respective one holding plate. When desiring to adjust a distance of the respective one connection rack, the respective one connection rack is removed from the respective one support column and is fixed to a desired position by inserting to the respective one longitudinal slot, thus adjusting the respective one holding plate.

The conventional shelf is simplified and is connected easily and conveniently, but it cannot accommodate the other objects which cannot be held on the respective holding plate.

The present invention has arisen to mitigate and/or obviate the afore-described disadvantages.

SUMMARY OF THE INVENTION

The primary object of the present invention is to provide a hook connection structure of a shelf which is configured to connect a fixing rod between two hooks, and the two hooks are connected on two bottoms of two connection racks, the fixing rod is mounted below a holding plate by using the two hooks, wherein the hook connection structure contains a respective one hook including a connection portion configured to connect with the fixing rod and having an extension extending from a top of the connection portion of the respective one hook, an engagement section extending downward from a front end of the extension, a contact rib extending from a bottom of the front end of the extension opposite to the engagement section, and a stop tab formed on a rear end of the extension, wherein a respective one connection rack includes a slot formed on a predetermined position of an elongated portion of the respective one connection rack and configured to obliquely receive the extension of the respective one hook, a notch defined on a front position of the slot and configured to engage with the engagement section of the extension of the respective one hook, such that the stop tab of the extension of the respective hook abuts against the elongated portion of the respective one rack, the respective one hook is connected on a bottom of the respective one connection rack, and the fixing rod is mounted below the holding plate to hang objects.

Another object of the present invention is to provide a hook connection structure of a shelf by which the respective one hook is connected on a bottom of the respective one connection rack, and the fixing rod is mounted below the holding plate by using the respective one hook or the screw bolt, thus hanging objects on the fixing rod and accommodating the other objects on the holding plate.

DETAILED DESCRIPTION OF THE PREFERRED EMBODIMENTS

Figure 8:
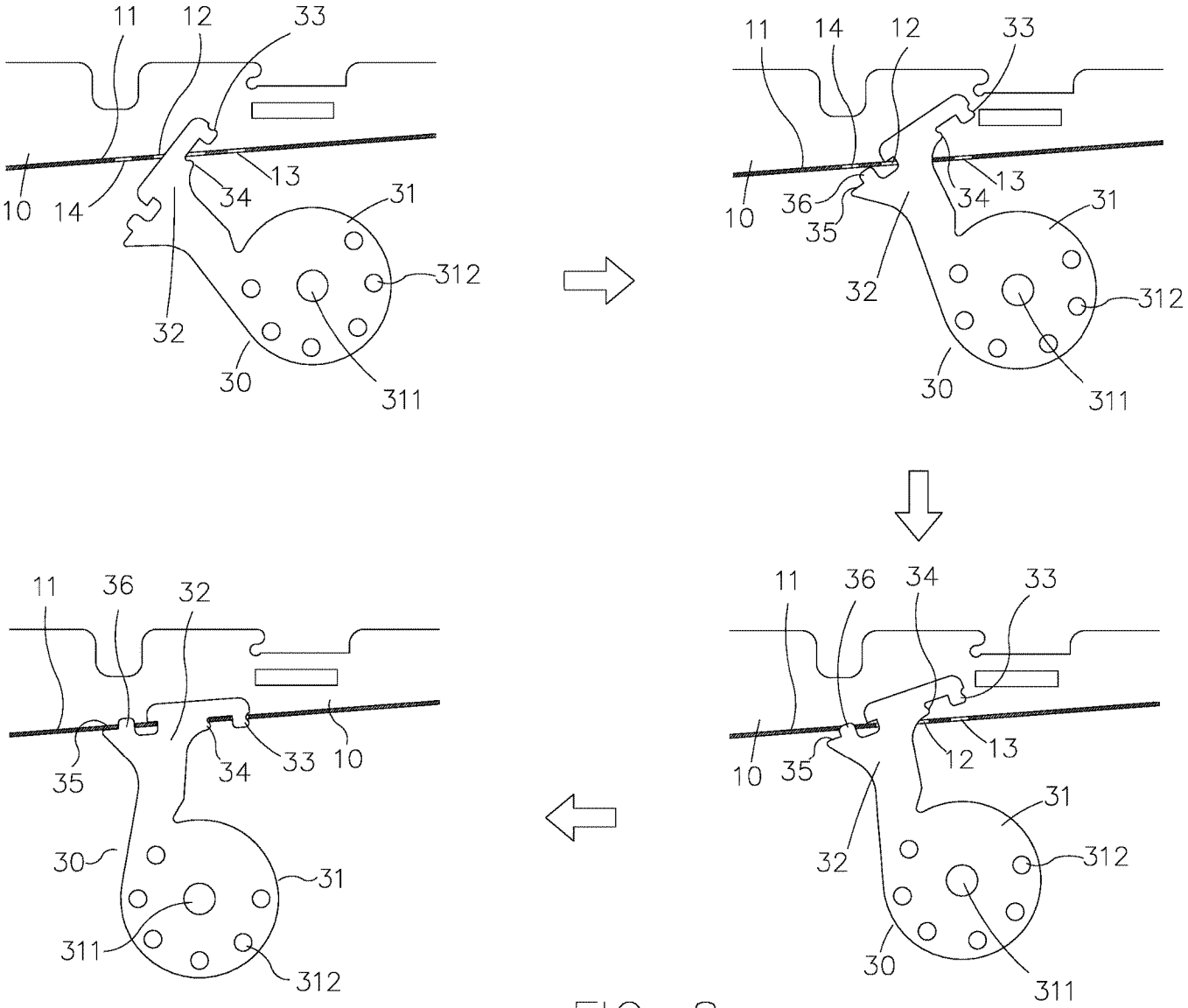
FIG. 8 is a side plan view showing the operation of the hook connection structure of the shelf according to another preferred embodiment of the present invention.
Figure 10:
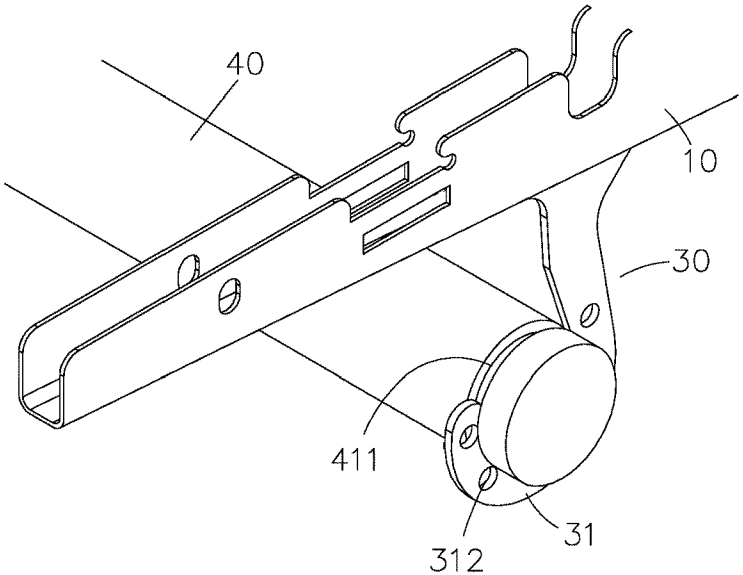
FIG. 10 is a perspective view showing the operation of the hook connection structure of the shelf according to another preferred embodiment of the present invention.
Figure 9:
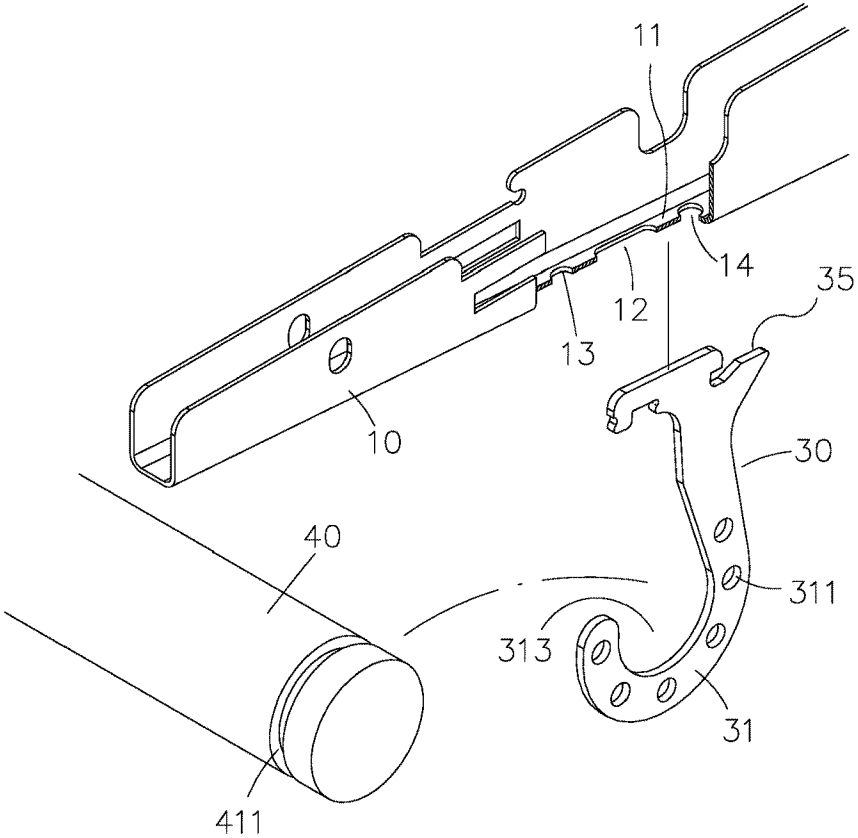
FIG. 9 is a perspective view showing the exploded components of a part of the hook connection structure of the shelf according to another preferred embodiment of the present invention.

With reference to FIGS. 1-10, a hook connection structure of a shelf according to a preferred embodiment of the present invention is configured to connect a fixing rod 40 between two hooks 30 which are connected on two bottoms of two connection racks 10, and the fixing rod 40 is mounted below a holding plate 20 by using the two hooks 30; wherein a respective one hook 30 includes a connection portion 31 configured to connect with the fixing rod 40, formed in a circle shape, having a central orifice 311 which is screwed with the fixing rod 40 by using a screw bolt 1, and having multiple peripheral orifices 312 defined around the central orifice 311 (as shown in FIG. 1-8), wherein the connection portion 31 is alternatively formed in a hook shape and has a retaining groove 313 configured to engage with the fixing rod 40 (as illustrated in FIGS. 9-10), and the connection portion 31 has an extension 32 extending from a top thereof, an engagement section 33 extending downward from a front end of the extension 32, a contact rib 34 extending from a bottom of the front end of the extension 32 opposite to the engagement section 33, a stop tab 35 formed on a rear end of the extension 32, and an insertion 36 extending upward from a top of the stop tab 35, wherein a respective one connection rack 10 includes a slot 12 formed on a predetermined position of an elongated portion 11 thereof and configured to obliquely receive the extension 32 of the respective one hook 30, a notch 13 defined on a front position of the slot 12 and configured to engage with the engagement section 33 of the extension 32 of the respective one hook 30, wherein a distance between the slot 12 and the notch 13 is equal to the engagement section 33 of the extension 32 of the respective one hook 30 and the contact rib 34 of the extension 32, and the respective one connection rack 10 further includes a trough 14 defined adjacent to the slot 12 and away from the notch 13 and configured to receive the insertion 36.

Figure 1:
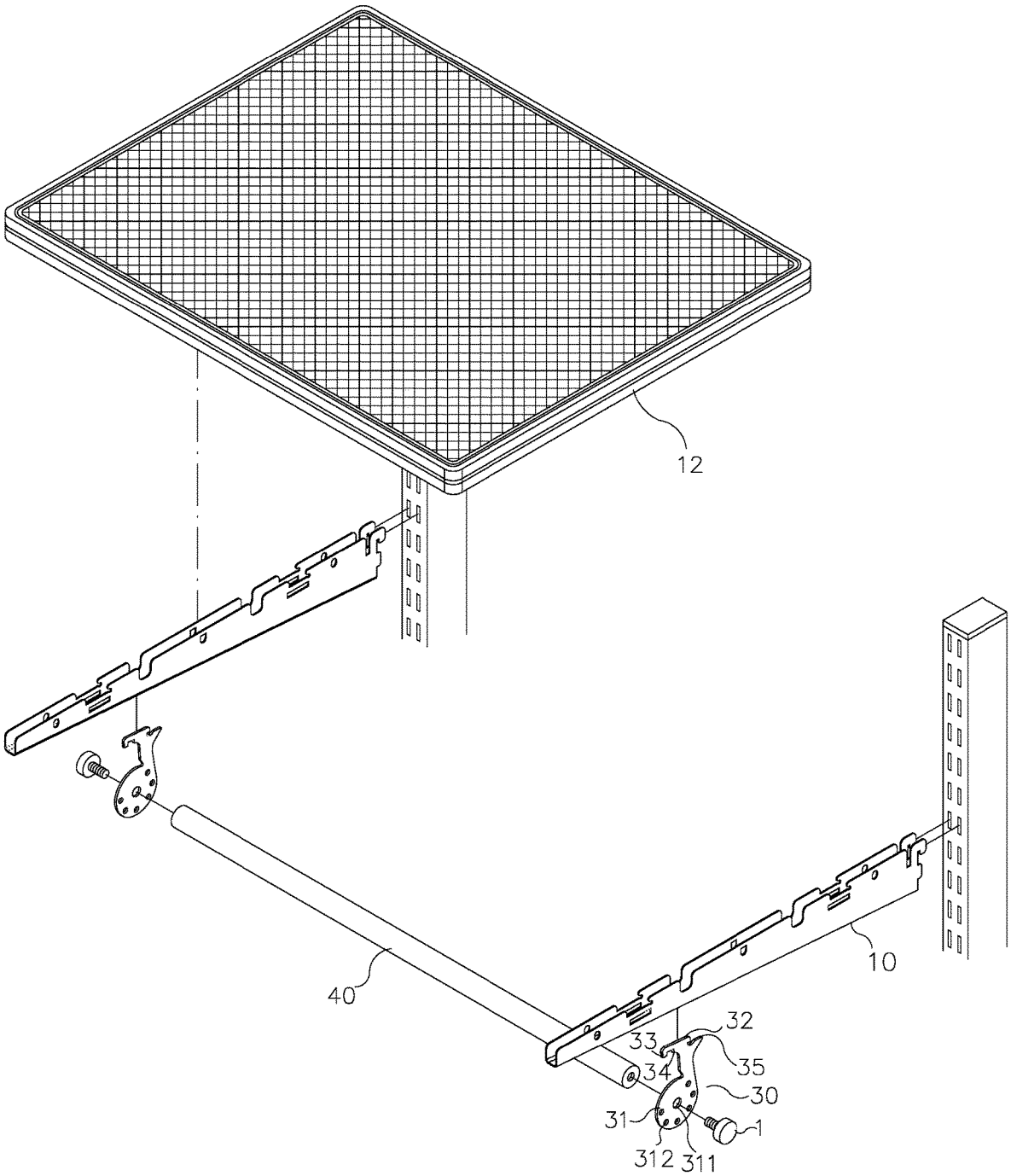
FIG. 1 is a perspective view showing the exploded components of a hook connection structure of a shelf according to a preferred embodiment of the present invention.
Figure 2:
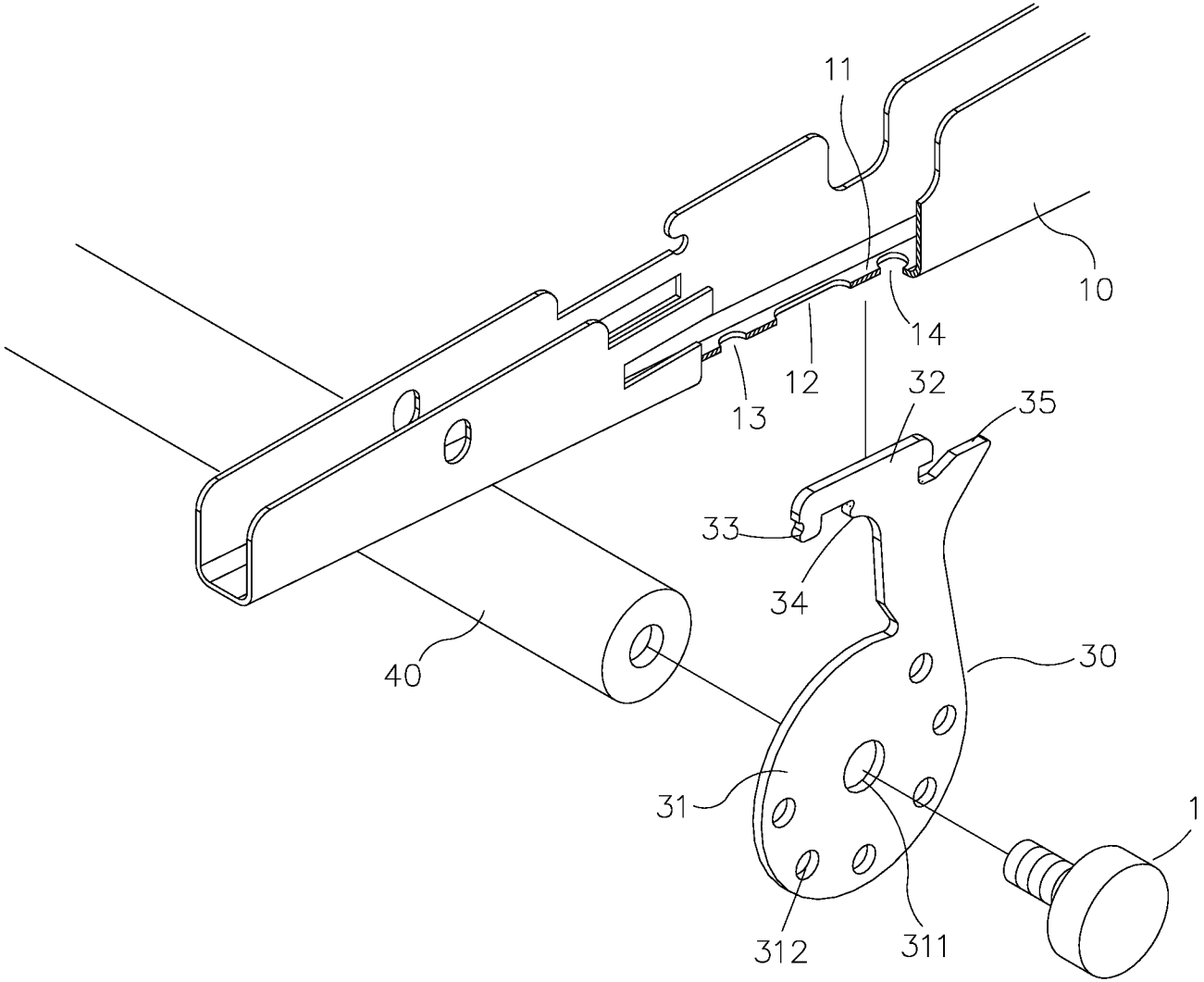
FIG. 2 is a perspective view showing the exploded components of a part of the hook connection structure of the shelf according to the preferred embodiment of the present invention.
Figure 3:
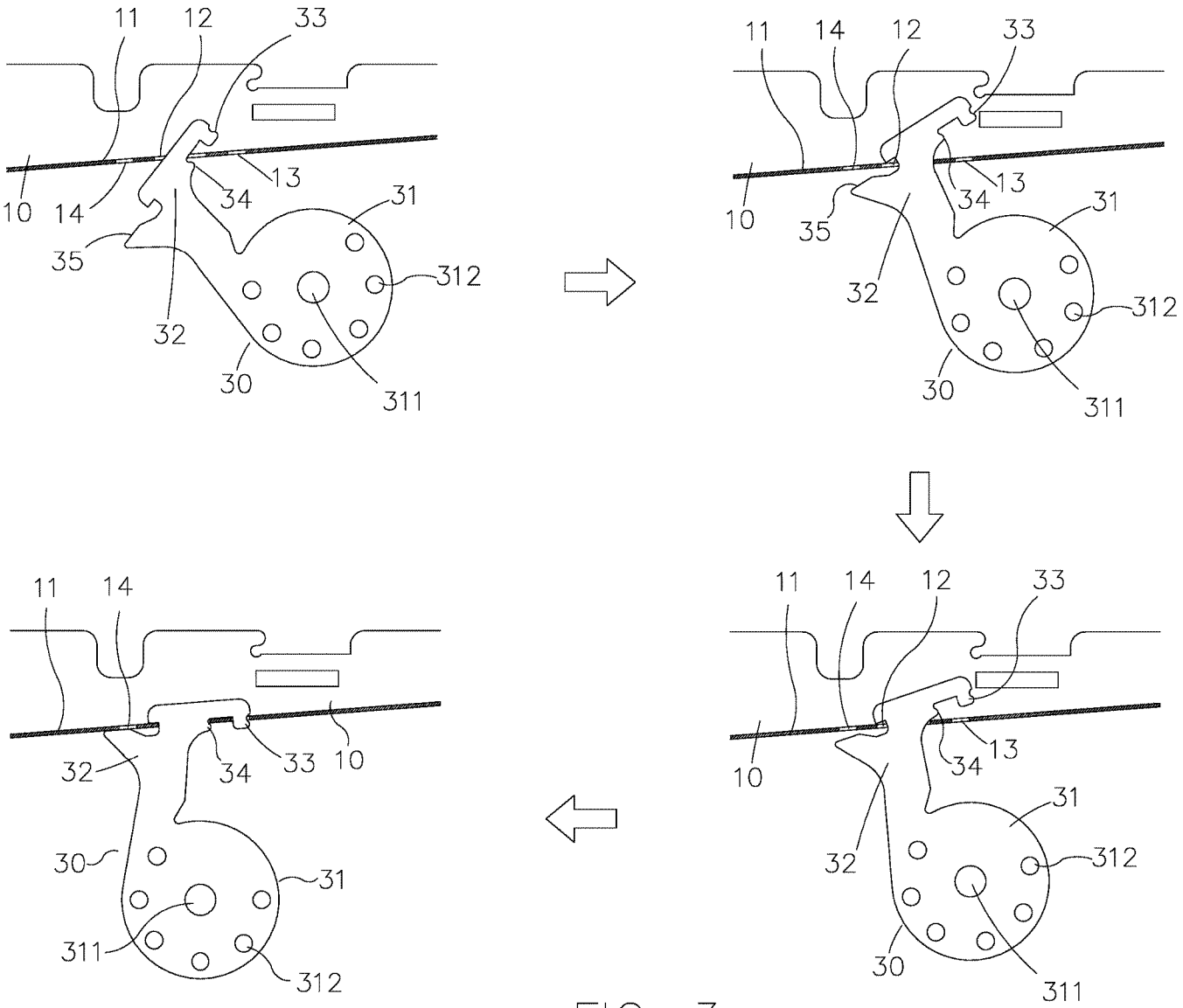
FIG. 3 is a side plan view showing the operation of the hook connection structure of the shelf according to the preferred embodiment of the present invention.
Figure 4:
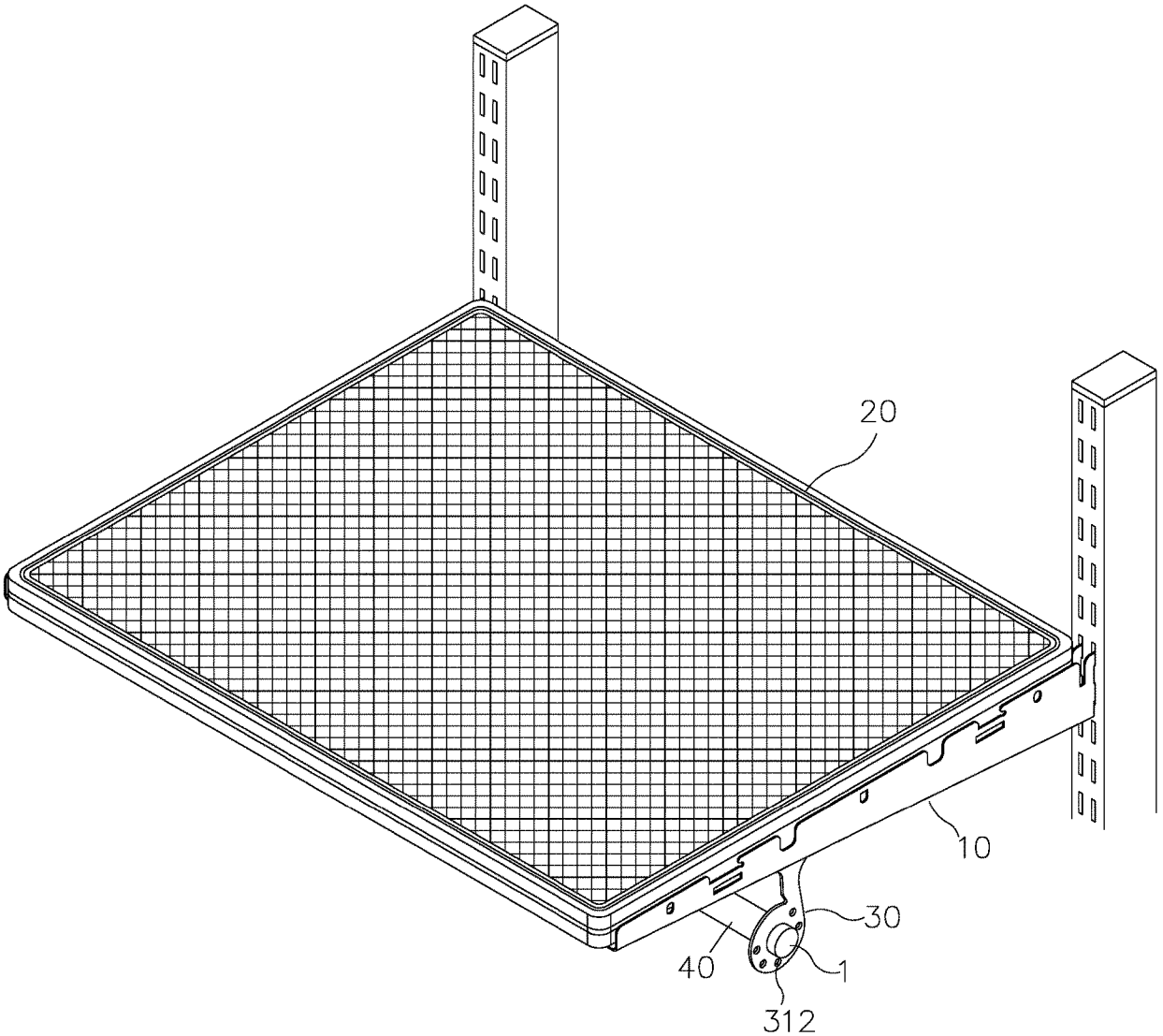
FIG. 4 is a perspective view showing the assembly of the hook connection structure of the shelf according to the preferred embodiment of the present invention.
Figure 5:
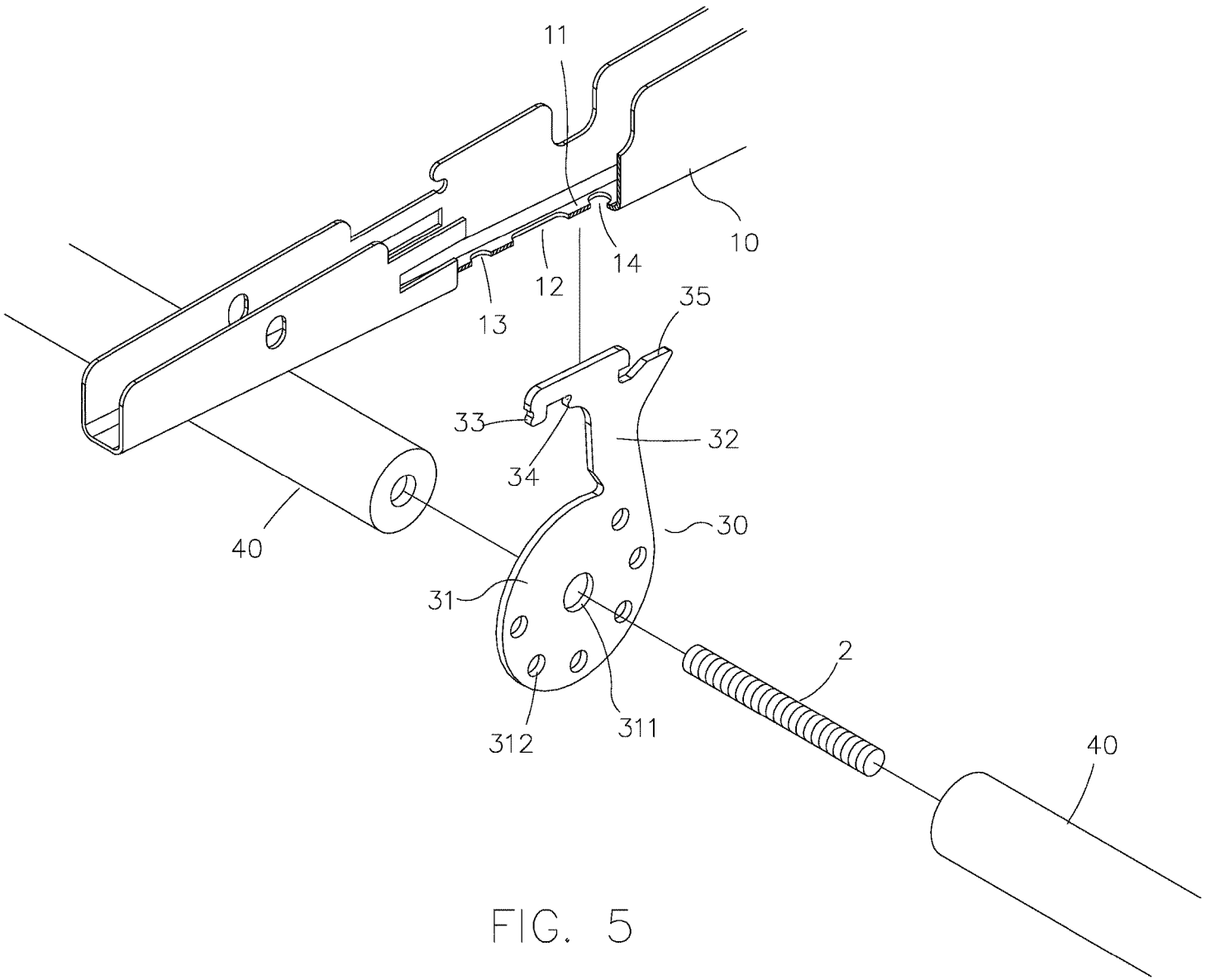
FIG. 5 is a perspective view showing the exploded components of a part of the hook connection structure of the shelf according to another preferred embodiment of the present invention.
Figure 6:
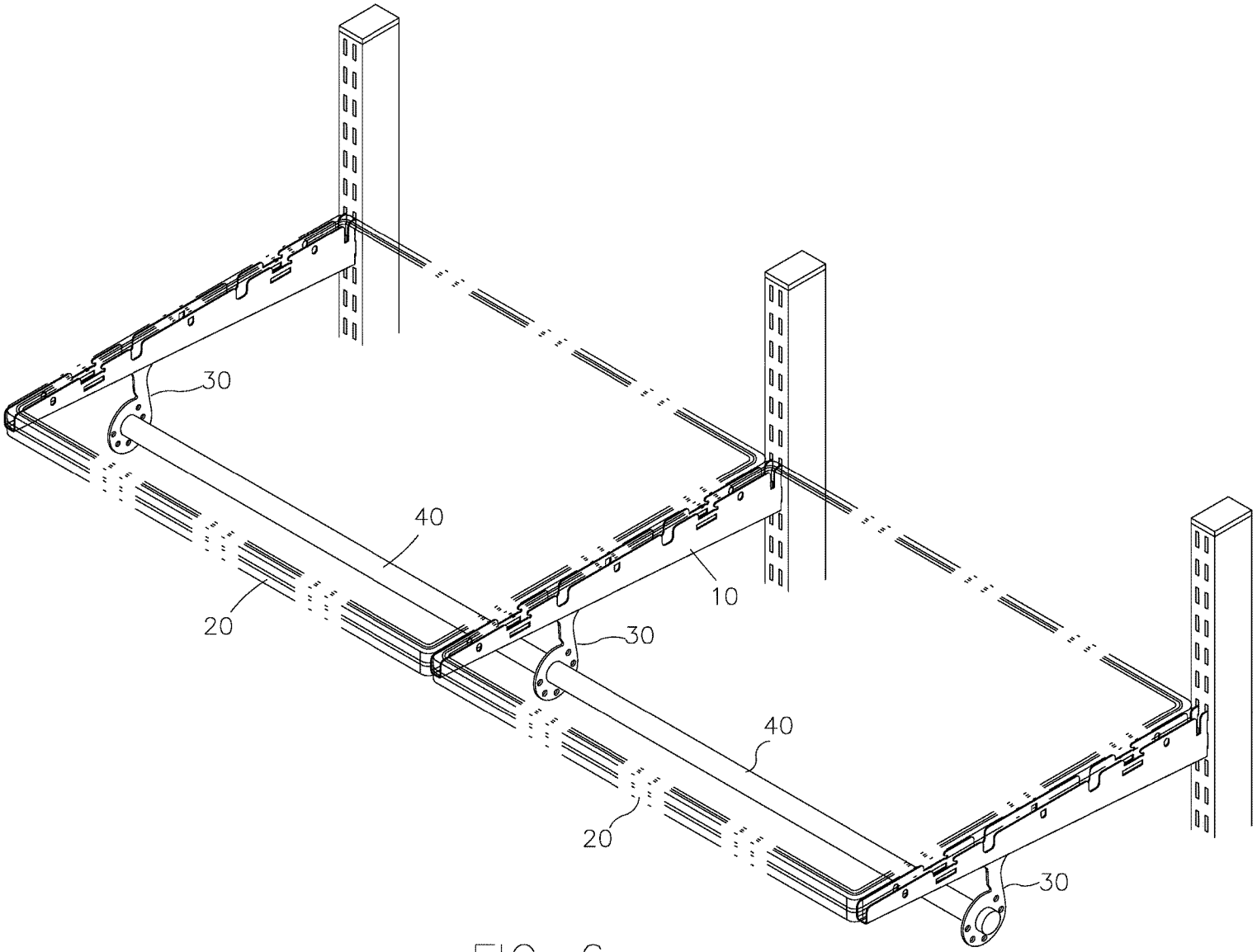
FIG. 6 is a perspective view showing the operation of the hook connection structure of the shelf according to another preferred embodiment of the present invention.
Figure 7:
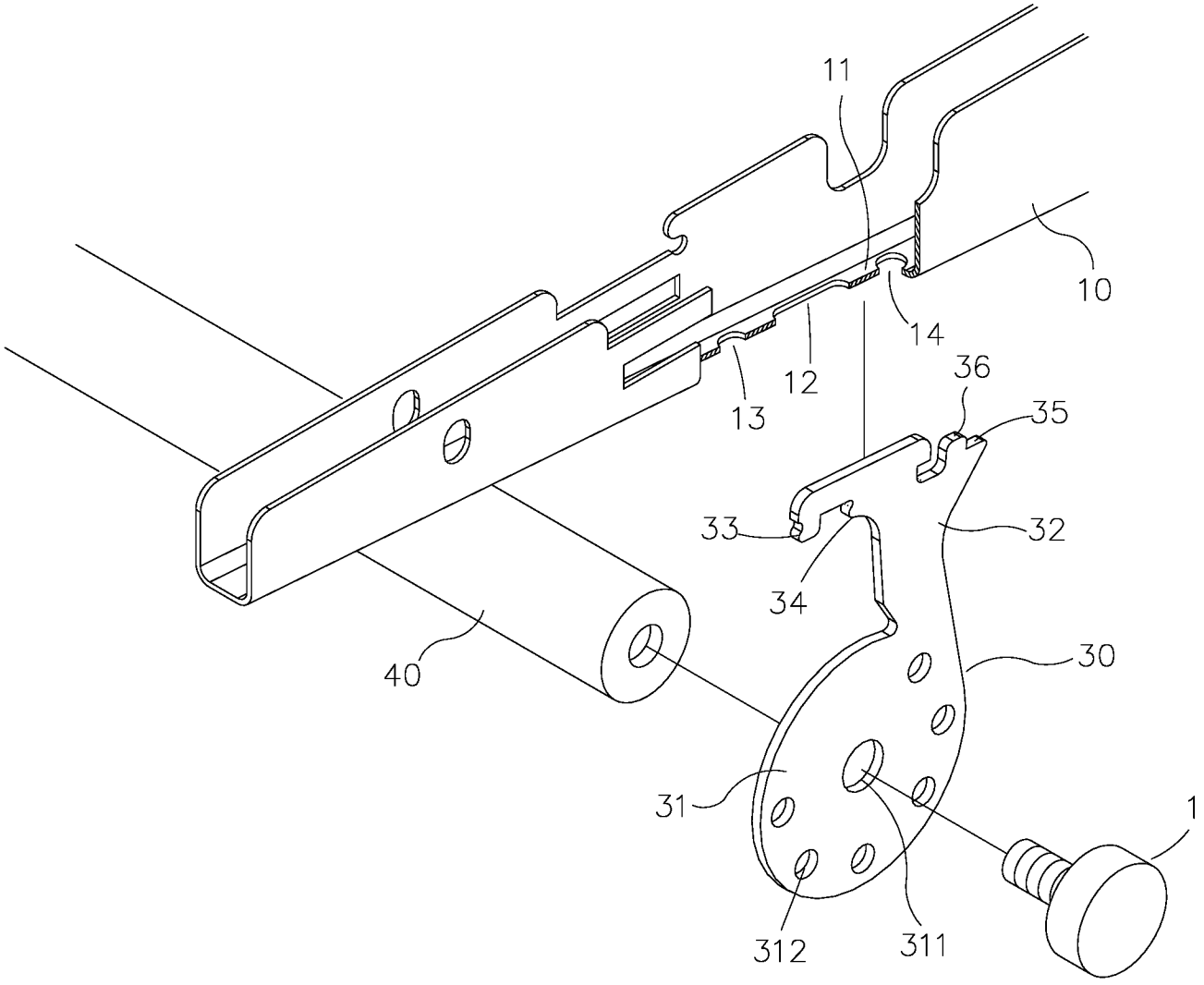
FIG. 7 is a perspective view showing the exploded components of a part of the hook connection structure of the shelf according to another preferred embodiment of the present invention.

As desiring to connect the respective one hook 30 on the bottom of the respective one connection rack 10, the extension 32 of the respective one hook 30 is obliquely received in the slot 12 of the respective one connection rack 10 and is rotated so as to engage the engagement section 33 with the notch 13, and the contact rib 34 is retained with the slot 12, and the stop tab 35 of the extension 32 of the respective one hook 30 abuts against the elongated portion 11 of the respective one connection rack 10. When the insertion 36 extends upward from the top of the stop tab 35, the insertion 36 is engaged in the trough 14 upward so that the respective one hook 30 is engaged with the respective one connection rack 10 (as shown in FIGS. 3 and 8), and the connection portion 31 of the respective one hook 30 is connected with the fixing rod 40 alternatively. For example, the central orifice 311 of the connection portion 31 of the respective one hook 30 is screwed with the fixing rod 40 by using the screw bolt 1. Alternatively, when two shelves are connected, a threaded post 2 is inserted through the central orifice 311 to screw with two fixing rods 40 (as illustrated in FIGS. 5-6). When the connection portion 31 of the respective one hook 30 is formed in the hook shape and has the retaining groove 313, the retaining groove 313 is engaged with a locking trench 41 of the fixing rod 40 (as shown in FIGS. 9-10), and the respective one hook 30 is connected on the bottom of the respective one connection rack 10. Thereby, the fixing rod 40 is configured to hang objects, and the holding plate 20 is configured to accommodate the other objects.

Accordingly, the hook connection structure of the shelf is configured to connect the fixing rod between two hooks which are engaged on two bottoms of two connection racks, and the fixing rod is mounted below the holding plate by using the two hooks, thus hanging the objects on the fixing rod and accommodating the other objects on the holding plate.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A hook connection structure of a shelf being configured to connect a fixing rod between two hooks which are connected on two bottoms of two connection racks, and the fixing rod being mounted below a holding plate by using the two hooks, the hook connection structure comprising:

a respective one hook from the two hooks including a connection portion configured to connect with the fixing rod and having an extension extending from a top of the connection portion of the respective one hook, an engagement section extending downward from a front end of the extension, a contact rib extending from a bottom of the front end of the extension opposite to the engagement section, and a stop tab formed on a rear end of the extension, wherein a respective one connection rack from the two connection racks includes a slot formed on a predetermined position of an elongated portion of the respective one connection rack and the slot is configured to obliquely receive the extension of the respective one hook, a notch defined on a front position of the slot, the notch is configured to engage with the engagement section of the extension of the respective one hook, such that the stop tab of the extension of the respective hook abuts against the elongated portion of the respective one connection rack, the respective one hook is connected on a bottom of the respective one connection rack, and the fixing rod is mounted below the holding plate to hang objects.

2. The hook connection structure of the shelf as claimed in claim 1, wherein a distance between the slot and the notch is equal to a distance between the engagement section of the extension of the respective one hook and the contact rib of the extension.

3. The hook connection structure of the shelf as claimed in claim 1, wherein the respective one hook further includes an insertion extending upward from a top of the stop tab, and the respective one connection rack further includes a trough defined adjacent to the slot and away from the notch and configured to receive the insertion.

4. The hook connection structure of the shelf as claimed in claim 1, wherein the connection portion of the respective one hook is formed in a circle shape, the connection portion has a central orifice screwed with the fixing rod by using a screw bolt, and the connection portion has multiple peripheral orifices defined around the central orifice.

5. The hook connection structure of the shelf as claimed in claim 1, wherein the connection portion is formed in a hook shape and has a retaining groove configured to engage with the fixing rod.

* * * * *